United States Patent [19]

Röh

[11] 4,384,422

[45] May 24, 1983

[54] FIREARMS

[75] Inventor: Horst Röh, Eckenforde, Fed. Rep. of Germany

[73] Assignee: Sterling Armament Company Limited, Dagenham, England

[21] Appl. No.: 187,142

[22] Filed: Sep. 15, 1980

[30] Foreign Application Priority Data

Sep. 25, 1979 [GB] United Kingdom ..... 7933099

[51] Int. Cl.[3] ..... F41C 1/00

[52] U.S. Cl. ..... 42/65; 42/69 B

[58] Field of Search ..... 42/65, 69 R, 69 B

[56] References Cited

U.S. PATENT DOCUMENTS

| | | | |
|---|---|---|---|
| 2,685,143 | 8/1954 | Bray et al. | 42/69 R |
| 3,045,556 | 7/1962 | Westmoreland | 42/65 X |
| 3,729,853 | 5/1973 | Critcher | 42/65 |
| 3,903,630 | 9/1975 | Dirstine | 42/69 R X |
| 3,965,604 | 6/1976 | Khaidurov et al. | 42/69 B |
| 4,067,131 | 1/1978 | Ruger et al. | 42/69 R X |
| 4,109,402 | 8/1978 | Guardamino | 42/65 |
| 4,128,957 | 12/1978 | Lee | 42/65 |
| 4,170,837 | 10/1979 | Smith | 42/65 |
| 4,213,263 | 7/1980 | Brouthers | 42/65 X |

*Primary Examiner*—David H. Brown

*Attorney, Agent, or Firm*—Scrivener, Clark, Scrivener and Johnson

[57] ABSTRACT

A hand gun is provided with a trigger operable against the action of a trigger return spring which takes the form of a compression spring received in the stock of the hand gun to thereby provide a resistance which is relatively constant and the compression is adjustable.

5 Claims, 1 Drawing Figure

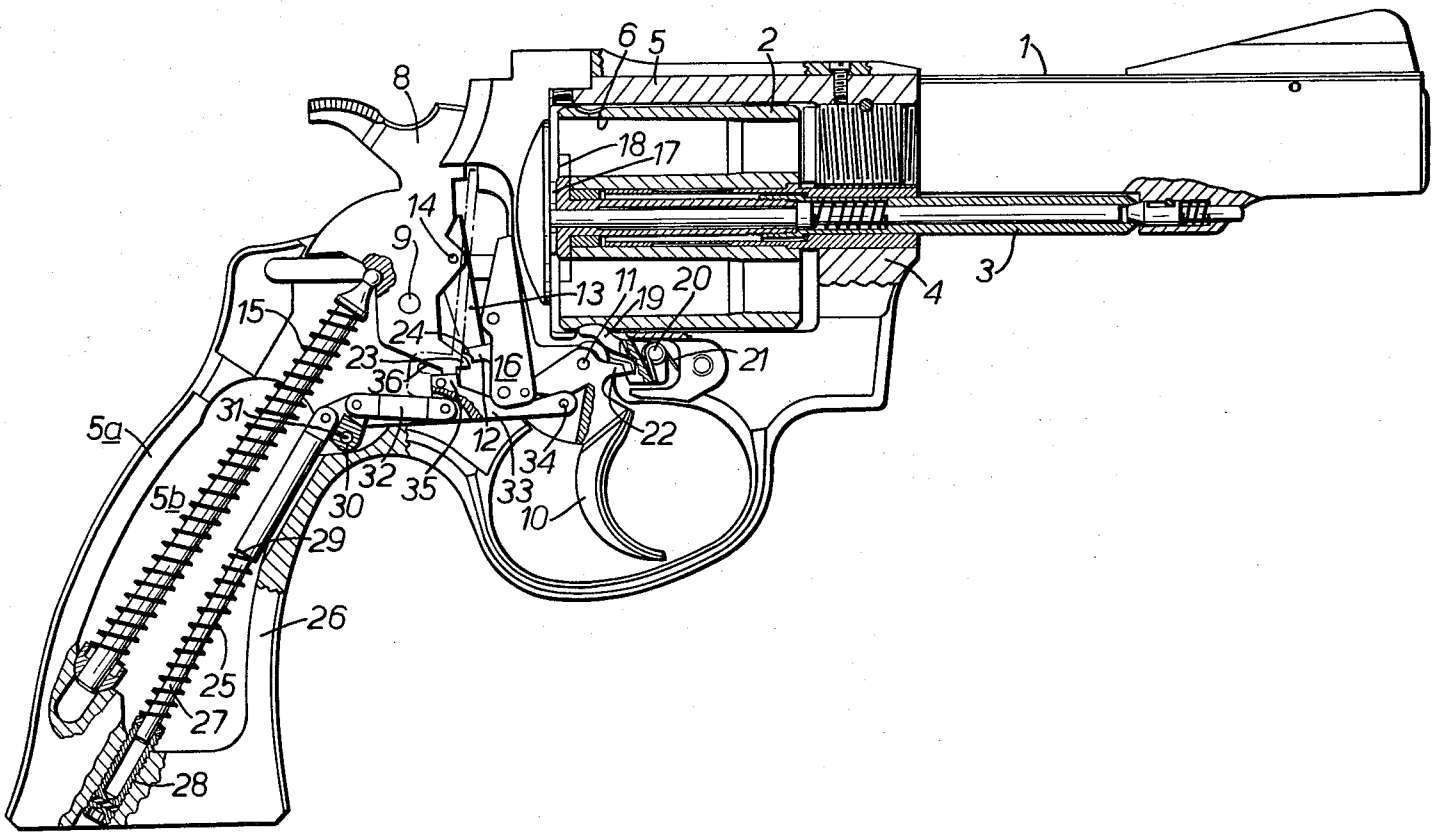
1
2
3
4
5
6
8
9
10
11
12
13
14
15
16
17
18
19
20
21
22
23
24
25
26
27
28
29
30
31
32
33
34
35
36
5a
5b

FIREARMS

This invention is concerned with improvements in and relating to firearms and in particular to hand guns.

Hand guns incorporating rotatable drums having a plurality of chambers whose axes are parallel to the axis of rotation of the drum and to the axis of the barrel are well known. Each chamber can be loaded with a round and each round can be fired when the chamber holding that round is coaxial with the barrel of the gun.

The firing mechanism of these known guns includes a trigger which when pulled will either move a hammer against the action of a hammer spring to an armed condition and in the final movement of the trigger release the hammer, called double action, or will release a hammer which has been moved to the armed condition by hand, called single action. Present day types of these guns usually have a capability of both types of action.

The trigger when pulled or squeezed moves against the resistance of a trigger return spring and this may be in the form of a leaf spring housed in a hand grip or stock and bearing upon a slide movable by the trigger, or a short compression spring housed in the said slide. As the trigger is pulled, the resistance offered by the spring increases and at the final part of the travel of the trigger during pulling or squeezing, the force which has to be exerted by the finger on the trigger is substantial. Where the gun is operating as a double acting weapon, the resistance to the trigger will also increase as the hammer approaches the armed condition against the action of the hammer spring which, like the trigger return spring, may be a leaf spring housed in the stock.

According to the present invention there is provided a hand gun comprising a receiver, a barrel coupled to the receiver, a drum rotatably positioned in the receiver and having a plurality of chambers each for receiving a round spaced about the cylinder axis, rotation of the cylinder serving to position each cylinder coaxially with the barrel, stock means coupled to the receiver by which the gun can be held in the hand of a user, a hammer pivotally mounted on the receiver and biased by a hammer spring about its pivot axis and a trigger which is pivotally mounted on the receiver and movable by the operator against the action of a trigger return spring to release the hammer where the hammer has been drawn back against the bias of the hammer spring away from the cylinder to an armed condition characterised in that the trigger return spring is a compression spring which is positioned in the stock and extends from a spring abutment set in the end of the stock remote from the receiver to an abutment on a member which is displaceably received in said stock and which is displaceable toward that spring abutment by said movement of the trigger by the operator.

By adopting a compression spring and positioning this in the stock, a length of spring can be used which will still be in a partially extended condition at completion of the pull or squeeze on the trigger and thus the rapid build-up of spring resistance toward the end of trigger movement can be avoided while still providing adequate resistance as well as trigger return.

The hammer spring may also comprise a compression spring and this also may be housed in the stock.

In order that the invention may be well understood there will now be described an embodiment thereof, given by way of example only, reference being had to the accompanying drawing which is a part broken away, part sectioned elevation of a hand gun with stock side plate removed.

The hand gun illustrated comprises a barrel 1, a cylinder 2 rotatable about an axis parallel with the barrel axis on a spindle 3 supported in a carrier 4 itself rotatable about an axis not shown parallel to the barrel axis to allow the cylinder to be moved in and out of a receiver 5 from which the barrel extends, for loading and unloading chambers 6 in the cylinder. From the receiver extends a stock portion **5*a* having side plates 5*b* of which one has been removed to show parts (to be described) set in the stock. The cylinder is rotatable to bring each chamber 6 to a position coaxial with the barrel in which position a round in that chamber can be fired. A firing mechanism is mounted in the receiver and comprises a hammer 8 pivoted at 9, and a trigger 10 pivoted at 11. The trigger includes a nose 12 which, on pulling of the trigger, clockwise as viewed in the drawing, will urge the hammer anti-clockwise by engaging a nib 13 pivoted on the hammer at 14 and urged anti-clockwise about that pivot by a spring (not shown). For double action the trigger is pulled sufficiently far for the nose 12 to pass the nib 13 and the hammer is then free to rotate clockwise about pivot 9 under the action of a hammer spring 15. Also pivoted upon the trigger is a pawl 16 which operates upon pull of the trigger to rotate the cylinder 2 by engagement with ratchet teeth 17 on an ejector 18 rotatably fast with the cylinder. A cylinder lock element 19 normally engaging the cylinder is rotatable about a pivot 20 by a nose 22 on the trigger when the trigger is pulled to disengage from the cylinder and allow the cylinder to be rotated by the pawl 16, and will be released before hammer fall so as to be biased back into a cylinder locking position by a spring 21**.

The form of the cylinder drive and cylinder locking arrangement are both known and are therefore not described in detail.

For single action the hammer is moved to the armed condition by hand and in this movement a step 23 on the hammer partly rotates the trigger by engaging nose 12 of the trigger. This continues until the step 23 seats on a recess 24 in the trigger nose and that condition will remain until such time as the trigger is pulled which will release step 23. The hammer will then rotate clockwise to fire the gun and the trigger nose will have passed forward of the return path of the nib 13. When the trigger is released the nose passes the nib which depresses clockwise about its pivot against the action of its spring.

As described thus far the hand gun is of known construction.

In each action described the trigger is pulled against the action of a trigger return spring 25. This is a compression spring housed in the stock **5*a* about a rod 27 slidable in abutment socket 28 set in the end of the stock remote from the receiver and adjustable to vary the compression of the spring, one end of which bears on the abutment socket and the other end of which bears on a shoulder 29 on the rod. The end of the rod remote from the abutment socket is coupled to a bell crank 30 pivoted on the stock at 31 and coupled by a link 32 to a trigger slide 33 pivoted at 34** to the trigger.

The effect of this arrangement is that the resistance to pull on the trigger can be kept relatively constant through the extent of the pull required to fire the gun because a spring can be selected, given the length of the stock, which will still have a degree of compressibility remaining after the gun has fired.

In addition to the advantage of a relatively long trigger return spring, the bell crank also is arranged to provide an increasing moment as the slide moves back, both arms of the bell crank moving toward a maximum distance from the pivot axis normal to the direction of thrust.

The slide includes a hammer stop 35 which upon return of the trigger to its rest condition under the action of spring 25 will engage an edge 36 of the hammer to move the hammer anti-clockwise to space the striker from the end of a cartridge in the chamber which is opposite the striker. Thus when the gun is first loaded the pin will be clear of the round in the uppermost chamber.

In like manner to the trigger return spring, the hammer return spring 15 is relatively long and the compression of that spring by rotation of the hammer to the armed condition requires a relatively constant force.

Thus a mechanism is provided which will allow the trigger to be pulled to fire the gun against a relatively constant force.

I claim:

1. A hand gun comprising a receiver, a barrel coupled to the receiver, a drum rotatably positioned in the receiver and having a plurality of chambers each for receiving a round spaced about the cylinder axis, rotation of the cylinder serving to position each cylinder coaxially with the barrel, stock means coupled to the receiver by which the gun can be held in the hand of a user, a hammer pivotally mounted on the receiver and biased by a hammer spring about its pivot axis, and a trigger which is pivotally mounted on the receiver and movable by the operator against the action of a trigger return spring to move the hammer against the bias of the hammer spring away from the cylinder to an armed condition and release the hammer, characterized in that the trigger return spring is a compression spring which is positioned in the stock means along the major dimension thereof from a spring abutment at the end of the stock means remote from the receiver to a displaceable abutment adjacent the end of the stock means nearest the receiver, the displaceable abutment being displaceable lengthwise of the stock means to compress the spring by a transfer member, means for transmitting an operating force from the trigger to the transfer member; when moved to move the hammer back, in a direction from which the direction of displacement of the displaceable abutment diverges and translating said operating force to the direction of displacement of the displaceable abutment.

2. A hand gun comprising a receiver, a barrel coupled to the receiver, a drum rotatably positioned in the receiver and having a plurality of chambers each for receiving a round spaced about the cylinder axis, rotation of the cylinder serving to position each cylinder coaxially with the barrel, stock means coupled to the receiver by which the gun can be held in the hand of a user, a hammer pivotally mounted on the receiver and biased by a hammer spring about its pivot axis and a trigger which is pivotally mounted on the receiver and movable by the operator against the action of a trigger return spring to move the hammer against the bias of the hammer spring away from the cylinder to an armed condition and release the hammer, characterized in that the trigger return spring is a compression spring housed lengthwise of the stock means to extend from a spring abutment at the end of the stock means remote from the receiver to a displaceable abutment adjacent the end of the stock means nearest the receiver, the displaceable abutment being movable by a pivotal crank member of which a part is movable in the direction of spring compression and a part is movable in a direction transverse to the compression direction by the trigger when the trigger is moved to move the hammer back.

3. A hand gun comprising a receiver, a barrel coupled to the receiver, a drum rotatably positioned in the receiver and having a plurality of chambers each for receiving a round spaced about the cylinder axis, rotation of the cylinder serving to position each cylinder coaxially with the barrel, stock means coupled to the receiver by which the gun can be held in the hand of a user, a hammer pivotally mounted on the receiver and biased by a hammer spring about its pivot axis and a trigger which is pivotally mounted on the receiver and movable by the operator against the action of a trigger return spring to move the hammer against the bias of the hammer spring away from the cylinder to an armed condition and release the hammer, characterized in that the trigger return spring is a compression spring located about a rod and between a spring abutment at the end of the stock means remote from the receiver, and a displaceable abutment fixed relative to the rod, the rod and displaceable abutment being displaceable by an arm of a bell crank lever the other arm of which is coupled to the trigger, the bell crank, upon movement of the trigger to move the hammer back translating the force applied by the trigger in a first direction to the direction of compression of the spring.

4. A hand gun according to claim 3 in which the bell crank arms are positioned to increase the moment exerted on it by the trigger as the trigger is pulled to move the hammer.

5. A hand gun according to claim 3 in which the spring abutment and the rod are slideably interengaged.

* * * * *